US009010901B2

(12) United States Patent
LeFevre et al.

(10) Patent No.: US 9,010,901 B2
(45) Date of Patent: Apr. 21, 2015

(54) SYSTEM AND METHOD FOR RETRACTING MEDIA IN AN INK APPLICATION ZONE OF A PRINTER

(71) Applicant: Xerox Corporation, Norwalk, CT (US)

(72) Inventors: Jason Matthew LeFevre, Penfield, NY (US); Douglas K. Herrmann, Webster, NY (US); Derek Albert Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/799,226

(22) Filed: Mar. 13, 2013

(65) Prior Publication Data

US 2014/0267484 A1 Sep. 18, 2014

(51) Int. Cl.

| | |
|---|---|
| ***B41J 15/16*** | (2006.01) |
| ***B41J 3/54*** | (2006.01) |
| ***B41J 11/00*** | (2006.01) |

(52) U.S. Cl.

CPC ..... *B41J 3/543* (2013.01); *B41J 11/0005* (2013.01); *B41J 15/165* (2013.01)

(58) Field of Classification Search

CPC ..... B41J 15/165; B41J 13/054; B41J 13/025; B41J 11/057

See application file for complete search history.

(56) References Cited

U.S. PATENT DOCUMENTS

| | | | | |
|---|---|---|---|---|
| 2001/0052913 | A1* | 12/2001 | Matsumoto et al. | 347/19 |
| 2005/0018029 | A1* | 1/2005 | Takagi et al. | 347/104 |
| 2007/0201934 | A1* | 8/2007 | Ito | 400/615.2 |
| 2008/0074447 | A1* | 3/2008 | Kondo | 347/104 |
| 2009/0189967 | A1* | 7/2009 | Sakano | 347/104 |
| 2012/0026233 | A1* | 2/2012 | Loper et al. | 347/16 |

* cited by examiner

*Primary Examiner* — Shelby Fidler

(74) *Attorney, Agent, or Firm* — Maginot Moore & Beck LLP

(57) ABSTRACT

A system and method for reducing or eliminating the amount of cockle appearing in a continuous web of print media web during periods of non-printing in an inkjet printer. The inkjet printer includes a print module ejecting ink in a printzone on the web at the location of a backer roller configured to support the web. A first and a second retractor engage the web on either side of the backer roller to apply a tension to the web supported at the backer roller. The web is retracted or pushed away from a face of the print module to substantially prevent web cockle from developing and coming into contact with the print module face.

8 Claims, 6 Drawing Sheets

SYSTEM AND METHOD FOR RETRACTING MEDIA IN AN INK APPLICATION ZONE OF A PRINTER

TECHNICAL FIELD

This disclosure relates generally to a printing system and methods for maintaining the condition of recording media in a printing system, and more particularly to systems and methods for reducing or eliminating distortion of the recording media occurring during periods of non-printing. Controlling the amount of distortion of the web is particularly important in cases where the web is in close proximity to sensitive hardware of a printing system, including hardware such as print modules and printheads. Controlling the distortion of the web is very important in cases where the web is in close proximity to sensitive hardware (such as the print-heads themselves).

BACKGROUND

In general, inkjet printing machines or printers include at least one printhead unit that ejects drops of liquid ink onto recording media or an imaging member for later transfer to media. Different types of ink can be used in inkjet printers. In one type of inkjet printer, phase change inks are used. Phase change inks remain in the solid phase at ambient temperature, but transition to a liquid phase at an elevated temperature. The printhead unit ejects molten ink supplied to the unit onto media or an imaging member. Such printheads can generate temperatures of approximately 110 to 120 degrees Celsius. Once the ejected ink is on media, the ink droplets solidify. The printhead unit ejects ink from a plurality of inkjet nozzles, also known as ejectors.

The media used in both direct and offset (transfix) printers can be in web form. In a web printer, a continuous supply of media, typically provided in a media roller, is entrained onto rollers that are driven by motors. The motors and rollers pull the web from the supply roller through the printer to a take-up roller. The rollers are arranged along a linear media path, and the media web moves through the printer along the media path. As the media web passes through a print zone opposite the printhead or heads of the printer, the printheads eject ink onto the web. Along the feed path, tension bars or other rollers remove slack from the web so the web remains taut without breaking.

Existing web printing systems use a registration control method to control the timing of the ink ejections onto the web as the web passes the printheads. One known registration control method that can be used to operate the printheads is the single reflex method. In the single reflex method, the rotation of a single roller at or near a printhead is monitored by an encoder. The encoder can be a mechanical or electronic device that measures the angular velocity of the roller and generates a signal corresponding to the angular velocity of the roller. The angular velocity signal is processed by a controller executing programmed instructions for implementing the single reflex method to calculate the linear velocity of the web. The controller can adjust the linear web velocity calculation by using tension measurement signals generated by one or more load cells that measure the tension on the web near the roller. The controller implementing the single reflex method is configured with input/output circuitry, memory, programmed instructions, and other electronic components to calculate the linear web velocity and to generate the firing signals for the printheads in the marking stations.

Another existing registration control method that can be used to operate the printheads in a web printing system is the double reflex method. In the double reflex method, each encoder in a pair of encoders monitors one of two different rollers. One roller is positioned on the media path prior to the web reaching the printheads and the other roller is positioned on the media path after the media web passes the color printheads. The angular velocity signals generated by the two encoders for the two rollers are processed by a controller executing programmed instructions for implementing the double reflex method to calculate the linear velocity of the web at each roller and then to interpolate the linear velocity of the web at each of the printheads. These additional calculations enable better timing of the firing signals for the printheads in the marking stations and, consequently, improved registration of the images printed by the marking stations in the printing system. Ejection of ink from the inkjet nozzles can be adjusted based on the calculations. A double reflex printing system is disclosed in issued U.S. Pat. No. 7,665,817.

While control of the rotational speed of rollers is critical to the proper registration of images, other factors besides web transport can affect image registration. For instance, the material properties of the recording media can affect registration. If the continuous web slips when engaged with one or more rollers in the media path, the position of the media web with respect to the printheads is affected and errors in images formed on the media web can occur. In addition, if the web either stretches, shrinks, or otherwise becomes distorted during transport through the printer or during imaging, poor quality images can occur. Likewise, the amount of ink deposited on the continuous web can affect the material properties of the web and result in misregistration of images as well. Consequently, improvements to a printing system and to printing images by taking into account the type of media, the amount of ink being deposited on the continuous web, and conditions occurring in the printer during periods of non-printing or non-use are desirable.

SUMMARY

A printing system for printing an image on a continuous web of recording media moving along a web path includes a backer roller, a first print module, and a web retraction device. The backer roller is configured to support the media moving along the web path at a backer roller location. The first print module is disposed adjacent to the backer roller wherein the first print module is configured to eject ink on the recording media. A web retraction device is disposed along the web path and is configured to contact the web at a first location along the web path before the backer roller location and at a second location along the web path after the backer roller location to increase the amount of web in contact with the first backer roller.

A method of adjusting the path of a continuous web of recording media moving though a printer provides a reduction in and/or an elimination of distortion or cockle occurring during periods of non-printing. The printer includes an inkjet print module ejecting ink droplets to provide an image on the moving web supported by a backer roller wherein the inkjet print module defines a face plane. The method includes stopping ejection of ink droplets from the inkjet print module, adjusting a speed of the web, moving a first contact surface of a first retract roller into contact with the web at a location adjacent to a first side of the backer roller, and moving a second contact surface of a second retract roller into contact with the web at a location adjacent to a second side of the backer roller.

A method for a printer having a continuous web of recording media configured to move along a web path of the printer provides a reduction in the amount of web cockle appearing in the web. The printer includes an inkjet print module ejecting ink and having a backer roller configured to support the web in a printzone. The method includes slowing and stopping the movement of the continuous web of recording media, moving a first retractor and a second retractor into contact with the continuous web of recording media on opposite sides of the backer roller, maintaining the position of the first retractor and the second retractor in contact with the continuous web of recording media, disengaging the first retractor and the second retractor from contact with the continuous web of recording media, starting the movement of the continuous web of recording media, and ejecting ink onto the moving continuous web of recording media.

DETAILED DESCRIPTION

Figure 1:
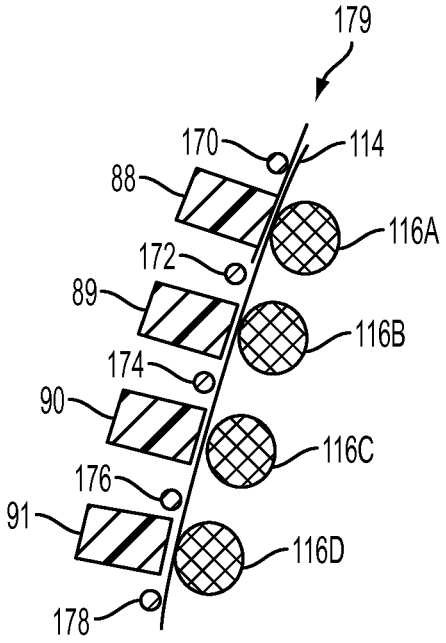
FIG. 1 is schematic end view of one embodiment of a portion of a printing system having a disengaged retract rollers.

For a general understanding of the environment for the system and method disclosed herein as well as the details for the system and method, the drawings are referenced throughout this document. In the drawings, like reference numerals designate like elements. As used herein the term "printer" or "printing system" refers to any device or system that is configured to eject a marking agent upon an image receiving member and includes photocopiers, facsimile machines, multifunction devices, as well as direct and indirect inkjet printers and any imaging device that is configured to form images on a print medium. As used herein, the term "process direction" refers to a direction of travel of an image receiving member, such as an imaging drum or print medium, and the term "cross-process direction" is a direction that is perpendicular to the process direction along the surface of the image receiving member. As used herein, the terms "web," "media web," and "continuous web of recording media" refer to an elongated print medium that is longer than the length of a media path that the web moves through a printer during the printing process. Examples of media webs include rollers of paper or polymeric materials used in printing. The media web has two sides having surfaces that can each receive images during printing. The printed surface of the media web is made up of a grid-like pattern of potential drop locations, sometimes referred to as pixels.

As used herein, the term "capstan roller" refers to a cylindrical member configured to have continuous contact with the media web moving over a curved portion of the member, and to rotate in accordance with a linear motion of the continuous media web. As used herein, the term "angular velocity" refers to the angular movement of a rotating member for a given time period, sometimes measured in rotations per second or rotations per minute. The term "linear velocity" refers to the velocity of a member, such as a media web, moving in a straight line. When used with reference to a rotating member, the linear velocity represents the tangential velocity at the circumference of the rotating member. The linear velocity v for circular members can be represented as: $v=2\pi r\omega$ where r is the radius of the member and $\omega$ is the rotational or angular velocity of the member.

Figure 6:
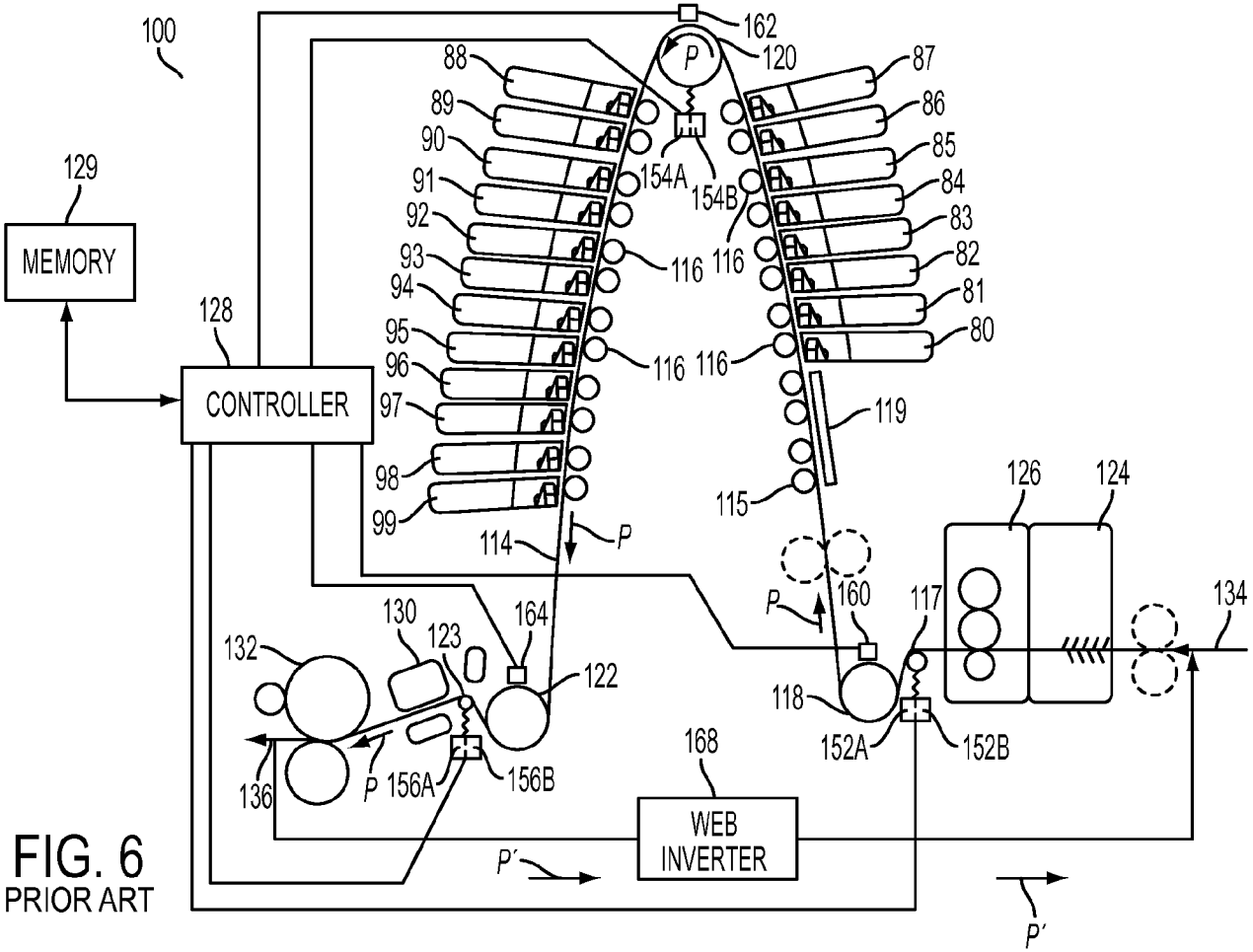
FIG. 6 PRIOR ART
FIG. 6 is a schematic view of a prior art inkjet imaging system that ejects ink onto a continuous web of media as the media moves past the printheads in the system.

FIG. 6 depicts a prior art inkjet printer 100 having elements pertinent to the present disclosure. In the embodiment shown, the printer 100 implements a solid (phase change) ink print process for printing onto a continuous media web. Although a method and system for reducing the amount of cockle in a continuous web of recording media are described below with reference to the printer 100 depicted in FIG. 6, the subject method and apparatus disclosed herein can be used in any printer, such as a cartridge inkjet printer, which uses serially arranged printheads to eject ink onto a continuous web image substrate.

FIG. 6 depicts a continuous web printer system 100 that includes twenty print modules 80-99, a controller 128, a memory 129, guide roller 115, guide rollers 116, pre-heater roller 118, apex roller 120, leveler roller 122, tension sensors 152A-152B, 154A-154B, and 156A-156B, and velocity sensors, such as encoders 160, 162, and 164. The print modules 80-99 are positioned sequentially along a media path P and form a print zone from a first print module 80 to a last print module 99 for forming images on a print medium 114 as the print medium 114 travels past the print modules. Each print module 80-83 provides a magenta ink. Each print module 84-87 provides cyan ink. Each print module 88-91 provides yellow ink. Each print module 92-95 provides black ink. Each print module 96-99 provides a clear ink as a finish coat. In all other respects, the print modules 80-99 are substantially identical. The media web travels through the media path P guided by rollers 115 and 116, pre-heater roller 118, apex roller 120, and leveler roller 122. A heated plate 119 is provided along the path adjacent roller 115. In FIG. 6, the apex roller 120 is an "idler" roller, meaning that the roller rotates in response to engaging the moving media web 114, but is otherwise uncoupled from any motors or other drive mechanisms in the printing system 100. The pre-heater roller 118, apex roller 120, and leveler roller 122 are each examples of a capstan roller that engages the media web 114 on a portion of its surface. A brush cleaner 124 and a contact roller 126 are located at one end of the media path P. A heater 130 and a spreader 132 are located at the opposite end 136 of the media path P.

A web inverter 168 is configured to direct the media web 114 from the end 136 of media path P to the beginning 134 of the media path through an inverter path P'. The web inverter 168 flips the media web and the inverter path P' returns the flipped web to the inlet 134 to enable single-engine ("Mobius") duplex printing where the print modules 80-99 form one or more ink images on a second side (second side ink image) of the media web after forming one or more images on the first side (first side ink image). In this operating mode, a first section of the media web moves through the media path P in tandem with a second section of the media web, with the first section receiving ink images on the first side of the media web and the second section receiving ink images on the second side. This configuration can be referred to as a "mobius" configuration. Each of the print modules 80-99 is configured to eject ink drops onto both sections of the media web. Each of the rollers 115, 116, 118, 120, and 122 also engage both the first and second sections of the media web. After the second side of the media web 114 is imaged, the media web 114 passes the end of the media path 136. Registration of a second side ink image to a first side ink image forms a duplex image. In another embodiment, one print module is configured to span the width of the recording media, such that two print modules located side by side are used to eject ink on the first and second sections of the web.

As illustrated in FIG. 6, each of the print modules 80-99 includes an array of printheads that are arranged across the width of both the first section of web media and second section of web media. Ink ejectors in each printhead in the array of printheads are configured to eject ink drops onto predetermined locations of both the first and second sections of media web 114.

Operation and control of the various subsystems, components and functions of printing system 100 are performed with the aid of a controller 128 and memory 129. In particular, controller 128 monitors the velocity and tension of the media web 114 and determines timing of ink drop ejection from the print modules 80-99. The controller 128 can be implemented with general or specialized programmable processors that execute programmed instructions. Controller 128 is operatively connected to memory 129 to enable the controller 128 to read instructions and to read and write data required to perform the programmed functions in memory 129. Memory 129 can also hold one or more values that identify tension levels for operating the printing system with at least one type of print medium used for the media web 114. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Encoders 160, 162, and 164 are operatively connected to preheater roller 118, apex roller 120, and leveler roller 122, respectively. Each of the encoders 160, 162, and 164 are velocity sensors that generate an angular velocity signal corresponding to an angular velocity of a respective one of the rollers 120, 118, and 122. Typical embodiments of encoders 160, 162, and 164 include Hall effect sensors configured to generate signals in response to the movement of magnets operatively connected to the rollers and optical wheel encoders that generate signals in response to a periodic interruption to a light beam as a corresponding roller rotates. Controller 128 is operatively connected to the encoders 160, 162, and 164 to receive the angular velocity signals. Controller 128 can include hardware circuits, software routines, or both, configured to identify a linear velocity of each of the rollers 120, 118, and 122 using the generated signals and a known radius for each roller.

Tension sensors 152A-152B, 154A-154B, and 156A-156B are operatively connected to a guide roller 117, apex roller 120, and post-leveler roller 123, respectively. The guide roller 117 is positioned on the media path P prior to the preheater roller 118. The post-leveler roller 123 is positioned on the media path P after the leveler roller 122. Each tension sensor generates a signal corresponding to the tension force applied to the media web at the position of the corresponding roller. Each tension sensor can be a load cell configured to generate a signal that corresponds to the mechanical tension force between the media web 114 and the corresponding roller.

In FIG. 6 where two sections of the media web 114 engage each roller in tandem, each of the tension sensors are paired to identify the tension on each section of the media web 114. In embodiments where one surface of the media web engages each roller, a single tension sensor can be used instead. Tension sensors 152A-152B generate signals corresponding to the tension on the media web 114 as the media web 114 enters the print zone passing print modules 80-99. The print zone is also known as the ink application zone or the "jetting zone." Tension sensors 154A-154B generate signals corresponding to the tension of the media web around apex roller 120 at an intermediate position in the print zone. Tension sensors 156A-156B generate signals corresponding to the tension of the media web around leveler roller as the media web 114 exits the print zone. The tension sensors 152A-152B, 154A-154B, and 156A-156B are operatively connected to the controller 128 to enable the controller 128 to receive the generated signals and to monitor the tension between apex roller 118 and the media web 114 during operation.

In the prior art system 100, whenever printing has been completed or the web is stopped for other reasons such as maintenance, the print modules are pulled away from or retracted from the surface of the web. The movement of the print modules away from the print media when the web is stopped involves physically moving the print-head and all of its associated hardware away from media. If the print modules are not moved away from the print media, the web can become distorted. In addition, the printheads located in the print module run the risk of touching the print media which can cause ink to be wicked from the inkjets. When wicking occurs, a purge cycle is required to return the inkjets to a proper condition to resume printing. Unnecessary purge cycles, which occur in the printing system, can be disastrous for printing system productivity. Excessive numbers of purge cycles also generate an unacceptable waste of ink.

Even if no contact occurs between a print module and the recording media during periods of non-printing, the print modules remaining in place can distort the recording media. This result occurs because the print heads have a temperature of approximately 115° C. which can distort the recording media. This distortion is also known as "cockle". The distortion results from a migration of moisture within the media.

Web distortion also dramatically increases the risk that the printhead touches the web which causes a wicking action of ink from the printhead and thereby necessitates the purge cycle or other printhead maintenance cycles. Even though pneumatic devices can be used to move the entire print-head module to a location in contact with alignment docking-pins during printing, and then back and away from the print media when the web comes to a stop, repeated movement of the modules can create printing errors. Movement to and away from the print media introduces the likelihood that the print modules become misaligned with the print media and with each other, thereby creating imaging errors. When this occurs, printhead alignment errors are corrected by a sophisticated feed-back loop using an IOWA sensor to sense and adjust for print-head module misalignment. Unfortunately, this procedure requires accurate and repeatable docking and undocking of the print modules from the alignment docking pins for every print run. The consistency of docking and undocking must be tightly controlled in an effort to enable acceptable printhead to printhead alignment and therefore color to color registration from one print run to the next print run and from one day to the next. In one embodiment, printhead modules are located in drawers which move on runners.

If the printhead modules are not retracted once printing has stopped, a severe amount of web cockle can result when the web is held, for instance, even at a nominal tension of two (2) pounds per linear inch (pli) if the web is stationary and the print modules remain positioned in the printing position. In the printing position, the printhead to web gap is nominally 0.020 inches or approximately 0.5 millimeters (mm). In this situation, the web cockle that develops can distort the web such that it protrudes 5 mm or more above a tangent line extending from one backer roller-to an adjacent backer roller. This distortion is sufficiently large to contact the print-head and cause print-head drooling which necessitates an ink purging cycle before printing can be resumed. Currently as described above, the printhead modules are retracted from the backer-rollers when printing has stopped, which is problematic because of docking repeatability. When a print module does not dock accurately, several hundred feet of web is wasted to print fiducial marks so that an alignment sensor, an IOWA sensor for instance, can complete a set-up routine to re-register the print modules and therefore the printheads relative to each other.

Referring now to FIG. 1, the prior art printer system 100 is modified to include a web retraction device 169 (See FIG. 3) including a plurality of retractors or retract rollers 170, 172, 174, 176, and 178, each of which is disposed on a side of a respective print module 88, 89, 90, and 91. The retract rollers are also known as idler rollers. Each of the print modules is spaced from the web 114 in sufficiently close proximity to the surface of the web for depositing ink droplet to form an image. Backer rollers 116A, 116B, 116C and 116D are disposed on the opposite side of the web from each of the print modules. While only the print modules 88, 89, 90, and 91 are illustrated in FIG. 1, each of the remaining print modules 80-87 and 92-99 in the modified printer system includes a retract roller disposed on either side of the print modules. In addition, while only one retract roller is illustrated as being disposed between adjacent print modules, in alternative embodiments, two or more retract rollers are disposed between adjacent print modules. In still another embodiment, one or more non-rotating bars replaces one or more or the rollers 170. 172. 174, 176, and 178.

FIG. 1 illustrates the position of the web 114 as the web is moving at the predetermined printing speed. The web 114 is being guided by all of the backer rollers 116, including the rollers 116A, 116B, 116C and 116D. The retract rollers 170, 172, 174, 176 and 178 (and the remaining retract rollers not illustrated) are disposed away from the surface of the web 114 in a non-contacting position. The retract rollers include extending cylinders spanning the width of the print media and include a diameter sufficiently small to be positioned in between the print modules when spaced from the web 114. In another embodiment, the retract rollers include a length greater than the width of the print media. Likewise, the diameter of the retract roller is sufficiently small to fit at least partially in-between the backer rolls as further described with respect to FIG. 2.

Figure 2:
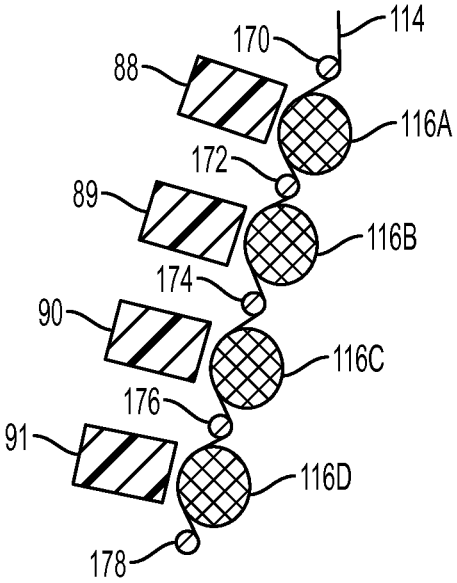
FIG. 2 is schematic end view of one embodiment of a portion of a printing system having engaged retract rollers

FIG. 2 illustrates the location of the retract rollers 170, 172, 174,176, and 178 when printing has stopped to thereby substantially reduce or eliminate the distortion of the web without moving the print modules 88, 89, 90, and 91 from the printing position. In this configuration, the printhead modules are still docked at a position to properly maintain the correct spacing between the print-heads and the backer rolls for a printing operation. The retract rollers move from the non-engaged position of FIG. 1 to engage the web 114, where a contact surface of each of the retract rollers contacts the web. By moving the retract roller into contact with the web 114, the web is pushed away from, or retracted from, the print heads which have the nominal temperature of 115° C. When the retract rollers engage the web, the retract rollers impart additional wrap around the backer rollers. By imparting the additional wrap of the web around the backer rollers, the amount of web in contact with the backer rollers increases. The pressure imparted to the web by the retract rollers when located at least partially between the backer rollers moves the web media into contact with the backer rollers and flush with the surface of the backer roller. Consequently, the heated print modules can remain docked in the printing position.

As can be seen in FIG. 1, a face plane 179 is defined by the front surface the print module 88. The remaining print modules also include front surfaces defining a plane. The face plane 179 is substantially parallel to the imaging surface of the web 114 which is also substantially parallel to a tangent of the rollers 116. In FIG. 1, the contact surface of the retract rollers is on a first side of the face plane 179 during printing. As illustrated in FIG. 2, the contact surface of the retract rollers moves on the other side of the face plane, past the tangent of the backer roller and into contact with the web 114.

Just before printing is resumed, the web speed increases into a web speed cycle-up mode in which the retract rollers stay engaged with the web until all of the media that was formerly parked in the jetting-zone has exited the jetting-zone. This means that the web media located between the first print module 80 to the last print module 99 is not printed on but passes the last print module 99 before printing can resume. In addition, this also means that the retract rollers are in contact with the web until the web has reached the printing operating speed. This insures that even the small portion of the web which is located immediately in front of the print-head cannot distort and touch the printhead. In the case of tandem-duplex printing (where a first side of the web is printed on by a first print engine and second side of the web is printed on by a second print engine), the retract rollers remain in contact with the web until all of the media that was "parked" (remained stationary during "stand-by") in the jetting zone in the first print engine has exited the jetting zone of the second print engine. This insures that no media that potentially was cockled/distorted from the heat of the print-heads of the first print engine can touch the printheads of the second print engine.

In another embodiment, the retract rollers can be disengaged from the web sequentially, such that the retract rollers associated with the first few print modules, for instance, print modules 80, 81, 82 are sequentially disengaged from the web prior to other retract rollers being disengaged. In this embodiment, printing of images can begin sooner, than if the entire amount of web located between module 80 and 99 passes module 99 before printing is resumed.

Figure 3:
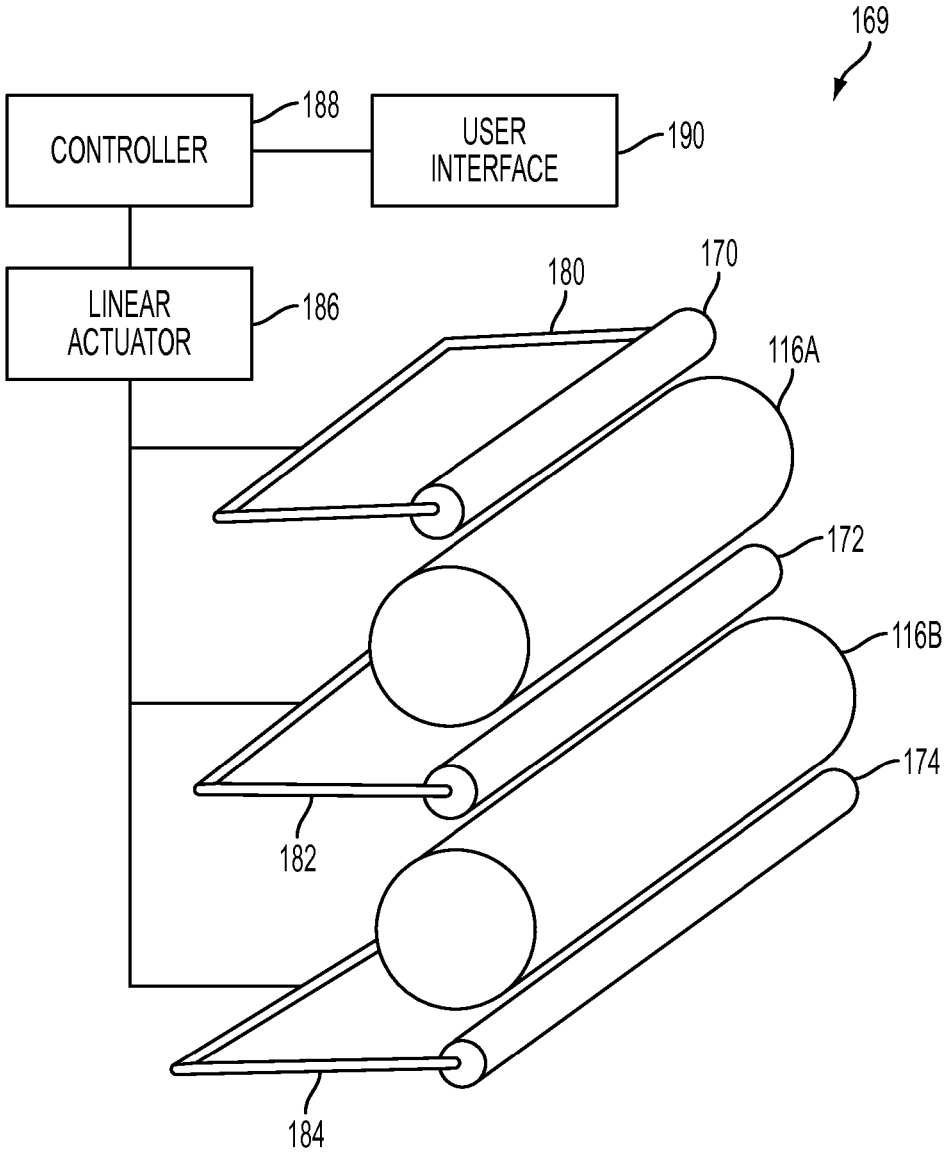
FIG. 3 is a schematic partial perspective view of a system for engaging and disengaging retract rollers.

FIG. 3 illustrates one embodiment of a mechanism configured to move the retract rollers into and out of contact with the web 114. In the FIG. 3 embodiment, retract rollers 170, 172, and 174 and backer rollers 116A and 116B are shown for the purposes of illustration. While only three retract rollers and two backer rollers are illustrated, the described configuration is applicable to the remaining retract rollers and backer rollers illustrated in FIG. 6. As can be seen in FIG. 3, each of the retract rollers 170, 172, and 174 is operatively connected to a respective frame 180, 182, and 184, each of which is configured for sliding movement in a larger printer frame supporting the frames and the attached rollers. Each of the frames includes an end to which each of the rollers 170, 172, and 174 are operatively connected to for rotational movement. Each of the retract rollers, in one embodiment, include simple idler rollers which rotate freely with bearings supporting the rotational axis. Each of the frames 180, 182, and 184 is operatively connected to a retractor mover such as a linear actuator 186 which provides for movement of the retract rollers away from the web 114 and extension of the retract rollers into contact with the web 114. A single linear actuator 186 moves each of the retract rollers via connecting linkages.

While a single linear actuator is illustrated to move the rollers into and out of engagement with the web 114, other configurations are possible. For instance in one embodiment, each of the frames 180, 182, and 184 includes a dedicated linear actuator which can be incorporated as part of the frame to move each retract roller individually. In another embodiment, a single linear actuator can be configured to control movement of some of the retract rollers but not all. For instance, retract rollers located adjacent to the print modules 80-87 can be controlled by a first linear actuator and retract rollers adjacent to the print modules 88-99 can be controlled by a second linear actuator. In other embodiments, one or more of the actuators include pneumatic, hydraulic, magnetic, mechanical linkages or bell crank actuators.

Each of the linear actuators is operatively connected to and controlled by a controller 188. The controller 188 can be a controller separately configured from the controller 128 or the controller 128 can be configured to control movement of the linear actuators. In addition, a user interface 190 is operatively connected to the controller 188 and configured in one embodiment to provide for manual control of the linear actuators by an operator. While manual control is not required, manual control can enable an operator to assess the proper functioning of the system and method described herein.

Figure 4:
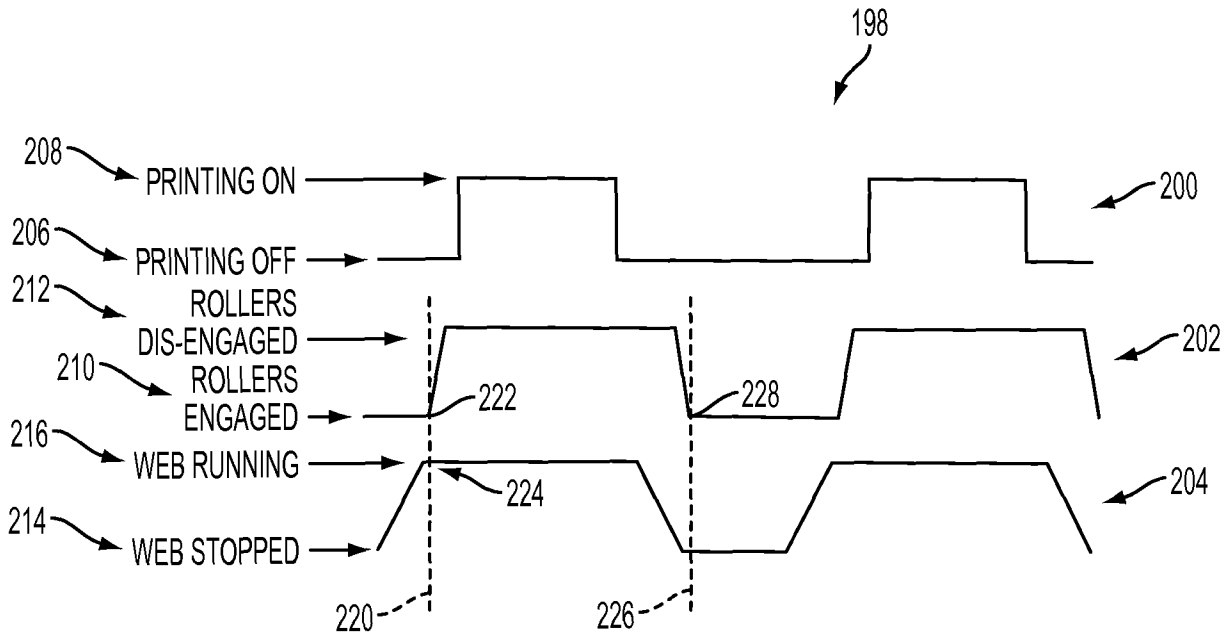
FIG. 4 is a timing chart illustrating a sequence of engaging and disengaging retract rollers with respect to time.

FIG. 4 shows a sequence diagram 198 illustrating an order or sequence of operations to mitigate the risk of paper distortion. The order of operations includes the timing of the movement of the retract rollers with respect to the web media when the web media is moving and when stopped. As illustrated in FIG. 4, the sequence diagram 198 includes a first or printing timing chart 200 for printing, a second or roller timing chart 202 for the movement of the retract rollers from engagement to disengagement with the web, and a third or web speed timing chart 204 for web motion. The printer timing chart 200 indicates a transition of the printer transitioning from the printing being in an OFF condition 206 to the printing being in an ON condition 208. The transition between the OFF condition 206 and the ON condition and vice versa is illustrated as being substantially instantaneous even though some time lag between states does occur. The roller timing chart 202 transitions from a rollers engaged state 210 to a roller disengaged state 212. The transition between states 210 and 212 takes more time than the transition between the printing OFF and ON states 206 and 208. The web speed timing chart 204 transitions between a web stopped state 214 and a web running state 216, the transition between states being more gradual than the transition between the rollers engaged state 210 and the rollers disengaged state 212.

As can be seen by a line 220, the retract rollers must start to disengage (point 222) from the web only after all of the media formerly parked in the printzone has exited from the printzone and then only after the web speed has ramped up and reached operating speed for printing at point 224. When the web comes to a stop on ramping down from operating speed, retract rollers must engage immediately as shown by the line 226 at the point 228 on the web speed timing chart 204.

Figure 5A:
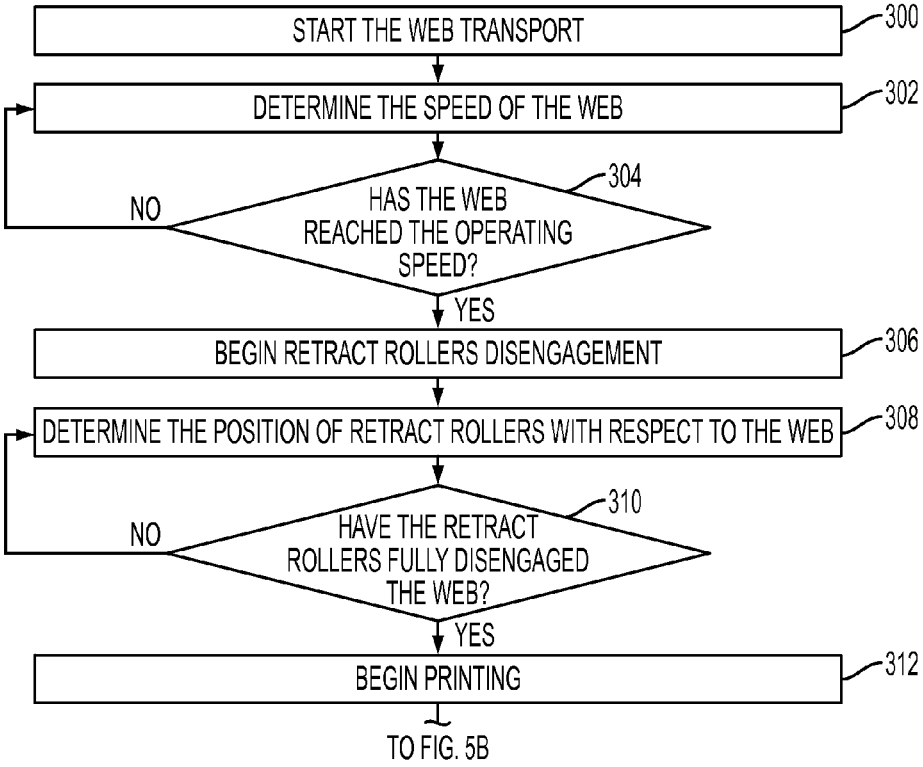
FIGS. 5A and 5B are a flow diagram of a method of adjusting the timing of the engagement and the disengagement of retract rollers with a continuous web of recording media.
Figure 5B:
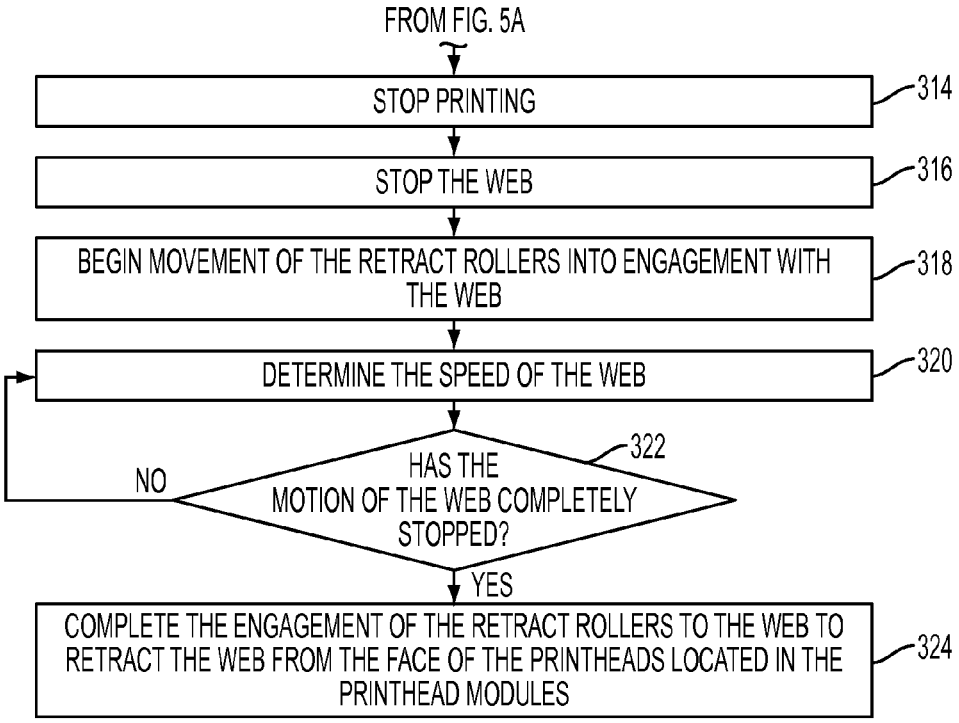

FIGS. 5A and 5B illustrate an example of a method to disengage and engage one or more of the retract rollers with the web. In this example, it is assumed that the printer has stopped printing and that the retract rollers are engaged with the web.

As illustrated, to being printing the web transport is started to begin moving the web through the printer (block 300). Once the web motion has started, the speed of the web is determined (block 302). Using the value of the determined web speed, it is determined whether the web has reached the operating speed required to begin printing (block 304). If the operating speed has been reached, the retract rollers can begin disengagement from the web (block 306). If not, the web speed is continued to be monitored (block 304). In addition, the web speed is continued to be monitored if the "distorted" web (which had been sitting stationary in front of the hot printheads) has been completely removed from the "printzone" prior to starting the retract-roller "disengage" sequence.

Once the retract rollers begin disengagement, the position of the retract rollers is determined with respect to the web (block 308). This position, in one embodiment, is determined with sensors that assess the position of the linear actuators. As the position of the web is being determined, the position is checked to determine when the rollers have fully disengaged from the web (block 310). Once the retract rollers are fully disengaged, printing can begin (block 312).

Printing continues until a print job is completed, at which point the printing is stopped (block 314). Once printing has stopped, a signal is transmitted to the motors moving the web to stop the web (block 316). The web does not, however, stop instantaneously, but occurs over a period of time due to the gradual slowing of the motors. After the signal to stop the web has been transmitted to the transport motors, the retract rollers begin moving towards the web for engagement with the web (block 318). During this movement, the speed of the web is determined (block 320). Once it is determined that the web has completely stopped (block 322), the engagement of the rollers with the web is completed to retract the web from the face of the printheads located in the printhead modules (block 324). In another embodiment, the retract rollers do not begin movement toward the web until the web has completely stopped.

During a "cycle up" sequence when printing is to begin, the retract rollers stay engaged until all of the web that was previously parked in the jetting zone has exited the jetting zone (of both engines in a tandem-duplex configuration). On a "cycle down" sequence where printing has stopped, the retract rollers, in different embodiments, are engaged either during cycle down, or immediately after the web has come to a stop. This is because, it takes approximately tens of seconds for paper to cockle.

The present disclosure solves the previously described problems which can occur when positioning and repositioning the printhead modules between successive print runs. By not moving the printhead modules between runs, the consistency of printhead registration from printhead to printhead, color-to-color, and print run-to-print run is improved. Throughout the entire process, the print-head modules do not move from a docked location to thereby provide the locating and distance requirements between the print-heads and the backer rolls. Consequently, the only situation in which the printhead modules drawer assembly are moved away from the docked position is when a printhead module or its component parts require maintenance (e.g. replacement, purging, etc.). While this situation is subject to the possibility of the registration changing, this situation occurs less frequently in the described embodiment. Any problems can be managed by the "stitch-motor" adjustment.

By leaving the print modules docked at the same location during and after printing, operating time for printing is increased since less time is wasted in performing set-up routines. The tolerances required for the retract rollers, the frames supporting the retract rollers, and the linear actuators, in one embodiment, are designed with looser tolerances when compared to other machine components, such as those directed to alignment and run-out features. In addition, in one embodiment, the retract rollers can be designed to fit into the current imaging devices. Simple pneumatic linear actuators can also be used can be used to move the retractors. Current machines can be modified with minor bracketing hardware and actuator hardware.

The disclosed embodiments substantially prevent the web from touching the print-heads thereby reducing or eliminating the number of printhead purge cycles, particularly in the case of an emergency stop when the web must be stopped immediately. The wear and tear on the print modules and the docking hardware associated with the print modules is reduced, even though the printhead modules on occasion are retracted from the printing position to perform maintenance.

It will be appreciated that variants of the above-disclosed and other features and functions, or alternatives thereof, can be desirably combined into many other different systems, applications or methods. Various presently unforeseen or unanticipated alternatives, modifications, variations or improvements can be subsequently made by those skilled in the art that are also intended to be encompassed by the following claims.

What is claimed is:

1. A printing system for printing an image on a continuous web of recording media moving along a web path comprising:

a backer roller configured to support the web of recording media moving along the web path at a first location, the backer roller defining a backer roller plane extending along a tangent substantially parallel to the web path at the first location;

a first print module positioned opposite the backer roller, the first print module having a module face that is parallel to the web path, the first print module being configured to eject ink onto the web of recording media passing along the web path between the module face and the backer roller plane as the web of recording media moves over the backer roller at the first location; and a web retraction device disposed along the web path, the web retraction device configured to move between a first position and a second position, the web retraction device at the first position does not contact the backer roller plane and the web of recording media moving over the backer roller as the first print module ejects ink onto the web of recording media at the first location and the web retraction device at the second position contacts the web of recording media and extends through the backer roller plane, while the web of recording media is stationary, at a portion on the web that is prior to the web of recording media reaching the first location and at a portion of the web that is after the web of recording media has passed the first location to increase an amount of the web of recording media in contact with the backer roller over an amount of the web of recording member contacting the backer roller during printing.

2. The printing system of claim 1, the web retraction device further comprising:

a first retractor configured to contact the portion of the web of recording media prior to the recording media reaching the first location when the web retraction device is at the second position; and a second retractor configured to contact the portion of the web of recording media after the recording media has passed the first location when the web retraction device is at the second position.

3. The printing system of claim 2, the first print module further comprising:

the first retractor and the second retractor include, respectively, a first contact surface and a second contact surface, the first contact surface of the first retractor and the second contact surface of the second retractor are out of contact with the web of recording media when the print module ejects ink onto the web of recording media at the first location on the web path, and the first contact surface and the second contact surface extend through the backer roller plane and contact the web of recording when the web of recording media is stationary.

4. The printing system of claim 2 wherein each of the first retractor and the second retractor have a length equal to a width of the web of recording media.

5. The printing system of claim 4, each of the first retractor and the second retractor further comprising:

a first roller and a second roller, the first roller being configured to rotate about an axis that is parallel to an axis about which the second roller rotates.

6. The printing system of claim 5 wherein the first roller and the second roller of the first retractor and the second retractor are configured to rotate freely.

7. The printing system of claim 2 further comprising:

a print module mover operatively connected to the print module, the print module mover being configured to move the print module toward and away from the backer roller.

8. The printing system of claim 2 further comprising:

a linear actuator operatively connected to the first and the second retractor to move the web retraction device between the first position and the second position.

* * * * *